US010796654B2

(12) United States Patent
Wang et al.

(10) Patent No.: US 10,796,654 B2
(45) Date of Patent: Oct. 6, 2020

(54) SWITCHING CIRCUIT, CONTROL CIRCUIT, DISPLAY DEVICE, GATE DRIVING CIRCUIT AND METHOD

(71) Applicants: BOE TECHNOLOGY GROUP CO., LTD., Beijing (CN); FUZHOU BOE OPTOELECTRONICS TECHNOLOGY CO., LTD., Fuqing, Fuzhou, Fujian (CN)

(72) Inventors: Baoqiang Wang, Beijing (CN); Xu Xu, Beijing (CN)

(73) Assignees: BOE TECHNOLOGY GROUP CO., LTD., Beijing (CN); FUZHOU BOE OPTOELECTRONICS TECHNOLOGY CO., LTD., Fuzhou (CN)

( * ) Notice: Subject to any disclaimer, the term of this patent is extended or adjusted under 35 U.S.C. 154(b) by 75 days.

(21) Appl. No.: 16/125,882

(22) Filed: Sep. 10, 2018

(65) Prior Publication Data

US 2019/0304393 A1 Oct. 3, 2019

(30) Foreign Application Priority Data

Mar. 27, 2018 (CN) ..... 2018 1 0258915

(51) Int. Cl.
*G09G 3/36* (2006.01)
*G09G 3/20* (2006.01)

(52) U.S. Cl.
CPC ... *G09G 3/3677* (2013.01); *G09G 2310/0205* (2013.01); *G09G 2310/0286* (2013.01); *G09G 2310/06* (2013.01)

(58) Field of Classification Search
CPC ..... G09G 3/3677; G09G 3/20; G09G 2310/0205; G09G 2310/0286; G09G 2310/06; G06F 3/041; G06F 3/0412
See application file for complete search history.

(56) References Cited

U.S. PATENT DOCUMENTS 8,031,154 B2 10/2011 Mamba et al.
2003/0030615 A1* 2/2003 Maeda ..... G09G 3/3648 345/90
2003/0206146 A1 11/2003 Yagi et al.
(Continued)

FOREIGN PATENT DOCUMENTS

CN 101196632 A 6/2008
CN 101231808 A 7/2008
(Continued)

OTHER PUBLICATIONS

The First Chinese Office Action dated Aug. 17, 2020; Appln. No. 2018102589150.

*Primary Examiner* — David Tung

(57) ABSTRACT

A switching circuit, a gate scanning signal control circuit, a gate driving circuit, a display device and a driving method are provided. The switching circuit includes a gate scanning signal receiving terminal, a second output terminal, and a third output terminal. The gate scanning signal receiving terminal of the switching circuit is configured to receive a gate scanning signal, and the switching circuit is configured to output the gate scanning signal to the second output terminal and the third output terminal simultaneously under control of the gate scanning signal.

15 Claims, 8 Drawing Sheets

(56) References Cited

U.S. PATENT DOCUMENTS

| | | | | |
|---|---|---|---|---|
| 2008/0186267 | A1* | 8/2008 | Mamba | G09G 3/3655 345/87 |
| 2008/0316156 | A1* | 12/2008 | Shigaki | G09G 3/3674 345/87 |
| 2010/0321365 | A1* | 12/2010 | Fanchiang | G09G 3/3655 345/211 |
| 2012/0068961 | A1* | 3/2012 | Mizuhashi | G06F 3/0416 345/174 |
| 2012/0139886 | A1* | 6/2012 | Lee | G09G 3/3677 345/209 |
| 2014/0072092 | A1* | 3/2014 | Jang | G11C 19/28 377/64 |
| 2014/0119492 | A1* | 5/2014 | Liu | G11C 19/28 377/64 |
| 2014/0252964 | A1* | 9/2014 | Wu | G09G 3/3655 315/161 |
| 2015/0091889 | A1 | 4/2015 | Kim et al. | |
| 2015/0212381 | A1* | 7/2015 | Wu | G09G 3/3677 349/41 |
| 2015/0355767 | A1* | 12/2015 | Abe | G06F 3/0412 345/174 |

FOREIGN PATENT DOCUMENTS

| | | | |
|---|---|---|---|
| CN | 102298896 | A | 12/2011 |
| CN | 102945657 | A | 2/2013 |
| CN | 104269134 | A | 1/2015 |
| CN | 106406612 | A | 2/2017 |

* cited by examiner

SWITCHING CIRCUIT, CONTROL CIRCUIT, DISPLAY DEVICE, GATE DRIVING CIRCUIT AND METHOD

CROSS-REFERENCE TO RELATED APPLICATION

The present application claims priority to the Chinese patent application No. 201810258915.0, filed on Mar. 27, 2018, the entire disclosure of which is incorporated herein by reference as part of the present application.

TECHNICAL FIELD

Embodiments of the present disclosure relate to a switching circuit, a gate scanning signal control circuit, a gate driving circuit, a display device and a driving method.

BACKGROUND

In the field of display technology, for example a pixel array of a liquid crystal display panel generally comprises gate lines in a plurality of rows and data lines in a plurality of columns crossed with the gate lines. The gate lines can be driven by a bonded driving integrated circuit. In recent years, with the continuous improvement of the preparation processes of amorphous silicon thin film transistors or oxide thin film transistors, a gate line driving circuit can be directly integrated on a thin film transistor array substrate to realize a GOA (Gate Driver on Array) to drive the gate lines. For example, a GOA including a plurality of cascaded shift register units can be used to provide switching state voltage signals for the gate lines in a plurality of rows of a pixel array respectively, so as to control, for example, the gate lines in a plurality of rows to be turned on sequentially, for example, to perform a line-by-line scanning, and at the same time, data signals are provided by data lines to pixel units in a corresponding row of the pixel array to form a gray voltage required for each gray scale of the display image in each pixel unit, thereby displaying one frame of image.

SUMMARY

At least one embodiment of the present disclosure provides a switching circuit, which comprises a gate scanning signal receiving terminal, a second output terminal, and a third output terminal, and the gate scanning signal receiving terminal of the switching circuit is configured to receive a gate scanning signal, and is configured to output the gate scanning signal to the second output terminal and the third output terminal simultaneously under control of the gate scanning signal.

For example, the switching circuit provided by an embodiment of the present disclosure further comprises an inverter sub-circuit, an output control sub-circuit, and an output sub-circuit. The inverter sub-circuit is configured to control a level of a first node in the switching circuit under control of the gate scanning signal; the output control sub-circuit is configured to transmit a common voltage input by a common voltage terminal to the third output terminal under control of the level of the first node; and the output sub-circuit is configured to output the gate scanning signal to the second output terminal and the third output terminal simultaneously under control of the gate scanning signal.

For example, in the switching circuit provided by an embodiment of the present disclosure, the inverter sub-circuit comprises a first transistor and a second transistor. A gate electrode of the first transistor is connected to a first electrode of the first transistor, and is configured to be connected to a first voltage terminal to receive a first voltage, and a second electrode of the first transistor is connected to the first node; and a gate electrode of the second transistor is configured to be connected to the gate scanning signal receiving terminal to receive the gate scanning signal, a first electrode of the second transistor is configured to be connected to the first node, and a second electrode of the second transistor is configured to be connected to a second voltage terminal to receive a second voltage.

For example, in the switching circuit provided by an embodiment of the present disclosure, the output control sub-circuit comprises a third transistor. A gate electrode of the third transistor is configured to be connected to the first node, a first electrode of the third transistor is configured to be connected to the third output terminal, and a second electrode of the third transistor is configured to be connected to the common voltage terminal to receive the common voltage.

For example, in the switching circuit provided by an embodiment of the present disclosure, the output sub-circuit comprises a fourth transistor. A gate electrode and a first electrode of the fourth transistor are electrically connected to each other, and are configured to be connected to the gate scanning signal receiving terminal and the second output terminal, and a second electrode of the fourth transistor is configured to be connected to the third output terminal.

For example, in the switching circuit provided by an embodiment of the present disclosure, the inverter sub-circuit further comprises a first transistor, a second transistor and a fifth transistor. A gate electrode and a first electrode of the first transistor are electrically connected to each other, and are configured to be connected to a first voltage terminal to receive a first voltage, and a second electrode of the first transistor is connected to a gate electrode of the fifth transistor; a second transistor, wherein a gate electrode of the second transistor is configured to be connected to the gate scanning signal receiving terminal to receive the gate scanning signal, a first electrode of the second transistor is configured to be connected to the first node, and a second electrode of the second transistor is configured to be connected to a second voltage terminal to receive a second voltage; and a fifth transistor, wherein the gate electrode of the fifth transistor is configured to be connected to the second electrode of the first transistor, a first electrode of the fifth transistor is configured to be connected to the first voltage terminal, and a second electrode of the fifth transistor is configured to be connected to the first node.

At least one embodiment of the present disclosure further provides a gate scanning signal control circuit, which comprises a gate scanning signal generating circuit and the switching circuit of any of the embodiments of the present disclosure. The gate scanning signal generating circuit comprises a first output terminal, and the first output terminal is configured to output the gate scanning signal; and the gate scanning signal receiving terminal of the switching circuit is connected to the first output terminal to receive the gate scanning signal.

For example, in the gate scanning signal control circuit provided by an embodiment of the present disclosure, the gate scanning signal generating circuit comprises a shift register unit configured for cascading.

For example, in the gate scanning signal control circuit provided by an embodiment of the present disclosure, the shift register unit comprises an input circuit, a pull-up node reset circuit, and an output circuit. The input circuit is configured to charge a pull-up node in response to an input signal; the pull-up node reset circuit is configured to reset the pull-up node in response to a reset signal; and the output circuit is configured to output a clock signal to the first output terminal under control of a level of the pull-up node.

For example, in the gate scanning signal control circuit provided by an embodiment of the present disclosure, the shift register unit further comprises a pull-down circuit, a pull-down control circuit, a pull-up node noise reduction circuit, and an output noise reduction circuit. The pull-down circuit is configured to control a level of the pull-down node under control of both the level of the pull-up node and a level of a pull-down control node; the pull-down control circuit is configured to control the level of the pull-down control node under control of the level of the pull-up node; the pull-up node noise reduction circuit is configured to reduce noise of the pull-up node under control of the level of the pull-down node; and the output noise reduction circuit is configured to reduce noise of the first output terminal under control of the level of the pull-down node.

At least one embodiment of the present disclosure further provides a gate driving circuit, which comprises a bilateral driving circuit, wherein each side of the bilateral driving circuit comprises a plurality of cascaded gate scanning signal control circuits provided by any of the embodiments of the present disclosure.

At least one embodiment of the present disclosure further provides a display device, which comprises the gate driving circuit provided by any of the embodiments of the present disclosure.

For example, the display device provided by an embodiment of the present disclosure further comprises a plurality of pixel units distributed in an array, a plurality of gate lines, and a plurality of common electrode lines. The pixel units in each row are connected to a same gate line and a same common electrode line, and the same gate line is electrically connected to the second output terminal of a gate scanning signal control circuit corresponding to the pixel units in the row of the bilateral driving circuit, and the same common electrode line is electrically connected to the third output terminal of the gate scanning signal control circuit corresponding to the pixel units in the row of the bilateral driving circuit.

For example, in the display device provided by an embodiment of the present disclosure, a first side driving circuit and a second side driving circuit of the bilateral driving circuit are capable of driving the same gate line in each row simultaneously.

At least one embodiment of the present disclosure further provides a driving method of the gate driving circuit, which comprises: outputting the gate scanning signal to the second output terminal and the third output terminal simultaneously under control of the gate scanning signal.

For example, the driving method of the gate driving circuit provided by an embodiment of the present disclosure further comprises: by the third output terminal of the switching circuit, outputting a common voltage when the gate scanning signal is at a first level; by the second output terminal and the third output terminal of the switching circuit, outputting the gate scanning signal when the gate scanning signal is at a second level.

BRIEF DESCRIPTION OF THE DRAWINGS

In order to clearly illustrate the technical solution of the embodiments of the present disclosure, the embodiments or the drawings of the related technical description will be briefly described in the following, it is obvious that the described drawings are only related to some embodiments of the present disclosure and thus are not limitative of the present disclosure.

DETAILED DESCRIPTION

Figure 1:
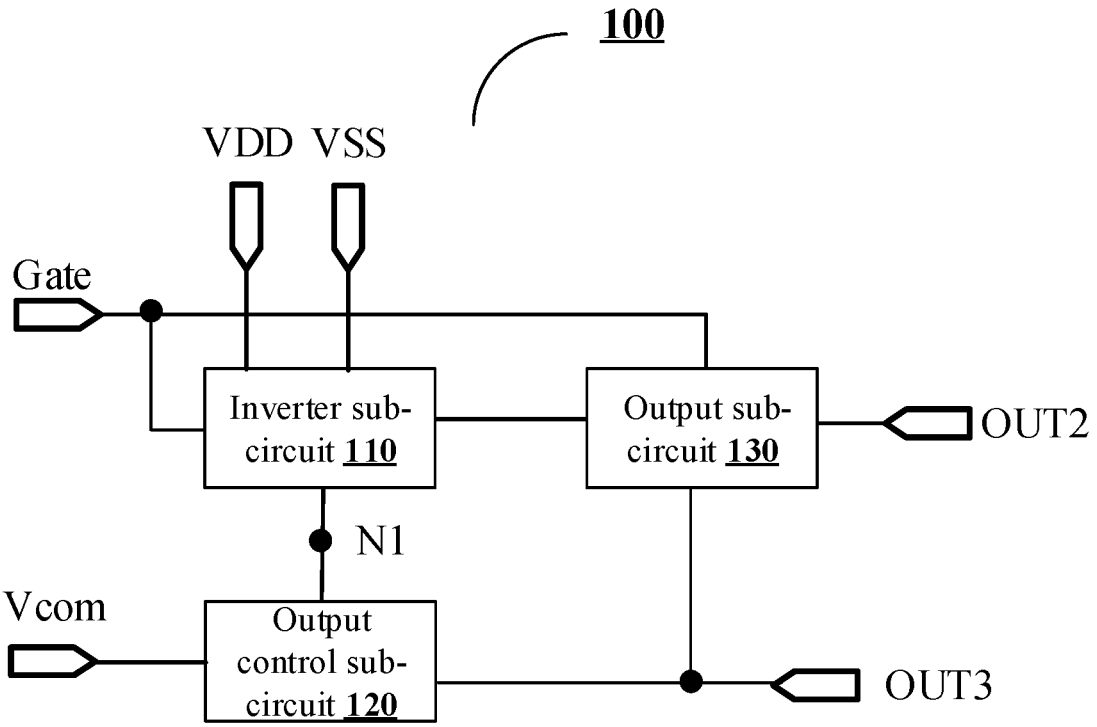
FIG. 1 is a schematic diagram of a switching circuit provided by an embodiment of the present disclosure.

In order to make objects, technical details and advantages of the embodiments of the invention apparent, the technical solutions of the embodiments will be described in a clearly and fully understandable way in connection with the drawings related to the embodiments of the invention. Apparently the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but can include an electrical connection, directly or indirectly. "On," "under," "right," "left" and the like are only used to indicate relative position relationship, and when the position of the object which is described is changed, the relative position relationship can be changed accordingly.

The disclosure is presented below by way of a few specific embodiments. In order to keep the following description of the embodiments of the present disclosure clear and concise, detailed descriptions of known functions and known components may be omitted. When any component of an embodiment of the present disclosure appears in more than one of the drawings, the components are denoted by identical or similar reference numerals in each of the drawings.

In the display panel technology, in order to realize the design of low cost and narrow bezel, GOA (Gate Driver on Array) technology can be adopted, that is, a gate driving circuit is integrated on the display panel through a thin film transistor manufacturing process, thereby achieving effects such as narrow bezel and reduced assembly cost and the like.

With the development of science and technology and the demand for high image quality by consumers, display screens are developing in a trend of large size, high resolution and high scanning frequency. However, on one hand, due to the increase of the size of a display screen, it is caused that the load of the gate driving circuit of the display screen is increased and resistance-capacitance (RC) delay occurs, so the image sticking phenomenon and insufficient charging phenomenon appear in displayed images when an LCD is turned off. On the other hand, the increase of the resolution of the display screen and the increase in the frame scanning frequency cause a significant decrease of the scanning time period of pixel circuits in each row, which also causes a risk of undercharging, therefore a gate driving voltage may not be able to charge all the selected pixel rows during a limited row scanning time period.

An embodiment of the present disclosure provides a switching circuit, which comprises a gate scanning signal receiving terminal, a second output terminal, and a third output terminal, and the gate scanning signal receiving terminal of the switching circuit is configured to receive a gate scanning signal, and the switching circuit is configured to output the gate scanning signal to the second output terminal and the third output terminal simultaneously under control of the gate scanning signal. Embodiments of the present disclosure also provide a gate scanning signal control circuit, a gate driving circuit, a display device, and a driving method comprising the above switching circuit.

With the switching circuit, the gate scanning signal control circuit, the gate driving circuit, the display device, and the driving method provided by the embodiments of the present disclosure, in one aspect, during the output of the gate scanning signal, for example, the gate scanning signal can be simultaneously transmitted through the gate line and the common electrode line to reduce a transmission resistance of the gate scanning signal, thereby reducing the driving load of the gate scanning signal and improving the charging rate of the display panel; on the other hand, during the period in which the gate scanning signal is not output, the transmission of the gate scanning signal can be separated from the transmission of the common voltage, the common electrode line transmits only the common voltage when the gate scanning signal is not output, thereby ensuring that the transmission of the gate scanning signal does not interfere with the transmission of the common voltage, and ensuring the normal display of the display panel.

Embodiments of the present disclosure and examples will be described in detail below with reference to the accompanying drawings.

FIG. 1 is a schematic diagram of a switching circuit provided by an embodiment of the present disclosure. As shown in FIG. 1, the switching circuit 100 comprises, for example, a gate scanning signal receiving terminal Gate, a second output terminal OUT2, and a third output terminal OUT3. The gate scanning signal receiving terminal Gate of the switching circuit 100 is configured to receive a gate scanning signal, and the switching circuit is configured to output the gate scanning signal to the second output terminal OUT2 and the third output terminal OUT3 simultaneously under control of the gate scanning signal, for example, to control a gate line electrically connected to the second output terminal OUT2 and a common electrode line electrically connected to the third output terminal OUT3 in the display panel to simultaneously transmit the gate scanning signal, to reduce the transmission resistance of the gate scanning signal, thereby reducing the driving load of the gate scanning signal and increasing the charging rate of the display panel. For example, the gate scanning signal receiving terminal Gate is connected to a circuit that generates a gate scanning signal to receive the gate scanning signal. The second output terminal OUT2 is connected to the gate line to drive a pixel circuit or pixel circuits connected to the gate line. The third output terminal OUT3 is connected to the common electrode line to output a gate scanning signal during the transmission of the gate scanning signal, and to output a common voltage during the period in which the gate scanning signal is not transmitted.

As shown in FIG. 1, in an example, the switching circuit 100 further comprises an inverter sub-circuit 110, an output control sub-circuit 120, and an output sub-circuit 130.

The inverter sub-circuit 110 is configured to control a level of a first node N1 of the switching circuit 100 under control of the gate scanning signal. For example, the inverter sub-circuit 110 can be connected to the gate scanning signal receiving terminal Gate, a first voltage terminal VDD, a second voltage terminal VSS, and the first node N1, and is configured to be turned on under the control of the level of the gate scanning signal received by the gate scanning signal receiving terminal Gate, such that the first node N1 is connected to the first voltage terminal VDD or connected to the second voltage terminal VSS, thereby controlling the level of the first node N1. For example, in the case where the turn-on level of the gate scanning signal is a high level and the turn-off level is a low level, when the gate scanning signal is at a high level, the level of the first node N1 is a second voltage (i.e., the low level), and in the case where the gate scanning signal is at a low level, the level of the first node N1 is the first voltage (i.e., the high level). It should be noted that the first voltage terminal VDD can be configured, for example, to continue to input a DC high level signal, for example, the DC high level signal is referred to as a first voltage, and the second voltage terminal VSS can be configured, for example, to continue to input a DC low level signal, for example, the DC low level signal is referred to as a second voltage, the second voltage is lower than the first voltage, and the following embodiments are the same as those described here and are not described again.

The output control sub-circuit 120 is configured to transmit the common voltage input by the common voltage terminal Vcom to the third output terminal OUT3 under the control of the level of the first node N1. For example, the output control sub-circuit 120 is connected to the common voltage terminal Vcom, the first node N1, the third output terminal OUT3, and the output sub-circuit 130, and is configured to be turned on under the control of the level of the first node N1, such that the third output terminal OUT3 is electrically connected to the common voltage terminal Vcom, thereby outputting the common voltage supplied from the common voltage terminal Vcom to the third output terminal OUT3. For example, when the gate scanning signal is at an turn-off level, such as a low level, the third output terminal OUT3 outputs a common voltage, thereby realizing that the transmission of the gate scanning signal is separated from the transmission of the common voltage signal, so that the common electrode line transmits only the common voltage during the period in which the gate scanning signal is not output, thereby ensuring that the transmission of the gate scanning signal does not interfere with the transmission of the common voltage, and ensuring the normal display of the display panel. The common voltage can be selected as needed, for example, a low level, such as a grounded level.

The output sub-circuit 130 is configured to output the gate scanning signal to both the second output terminal OUT2 and the third output terminal OUT3 simultaneously under the control of the gate scanning signal. For example, the output sub-circuit 130 is configured to be connected to the gate scanning signal receiving terminal Gate, the second output terminal OUT2, and the third output terminal OUT3, and is turned on under the control of the gate scanning signal received by the gate scanning signal receiving terminal Gate, so that the second output terminal OUT2 and the third output terminal OUT3 are respectively electrically connected to the gate scanning signal receiving terminal Gate; therefore, the gate scanning signal received by the gate scanning signal receiving terminal Gate can be output to both the second output terminal OUT2 and the third output terminal OUT3 simultaneously.

Figure 2A:
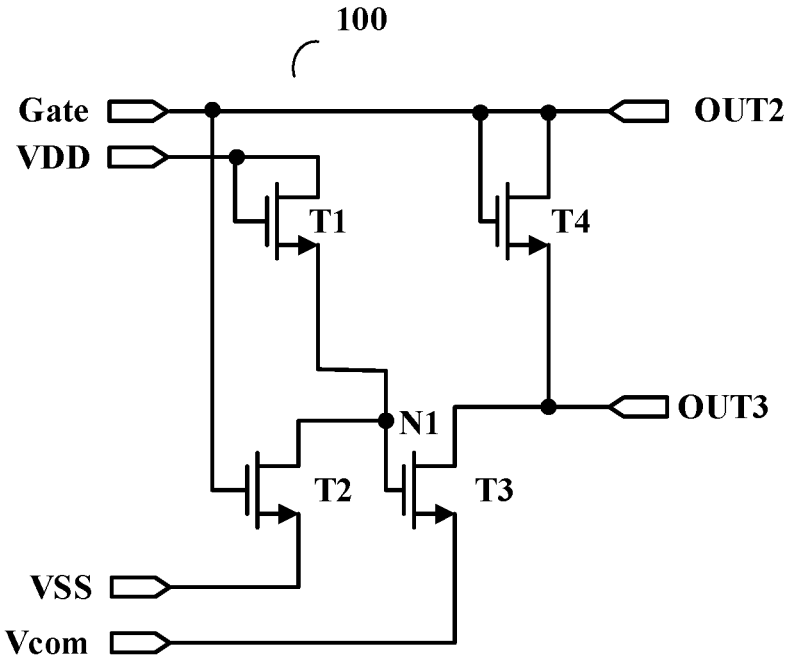
FIG. 2A is a circuit diagram of a specific implementation example of the switch circuit as shown in FIG. 1.

For example, the switching circuit 100 as shown in FIG. 1 may be specifically implemented as a circuit structure as shown in FIG. 2A in one example.

As shown in FIG. 2A, in this example, in more detail, the inverter sub-circuit 110 can be implemented as a first transistor T1 and a second transistor T2. A gate electrode of the first transistor T1 and a first electrode of the first transistor T1 are connected to each other, and are configured to be both connected to the first voltage terminal VDD to receive the first voltage, and a second electrode of the first transistor T1 is connected to the first node N1. A gate electrode of the second transistor T2 is configured to be connected to the gate scanning signal receiving terminal Gate to receive the gate scanning signal, a first electrode of the second transistor T2 is configured to be connected to the first node N1, and a second electrode of the second transistor T2 is configured to be connected to the second voltage terminal VSS to receive the second voltage.

Figure 2B:
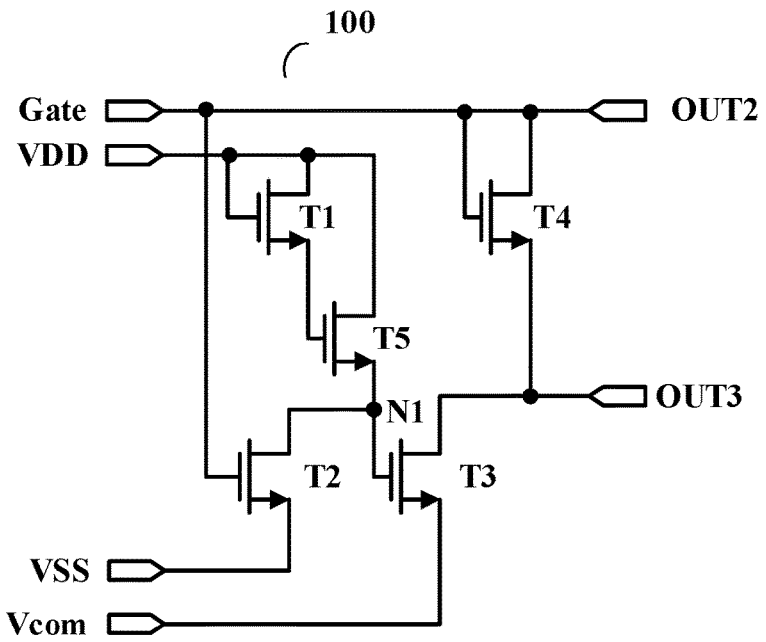
FIG. 2B is a circuit diagram of another specific implementation example of the switch circuit as shown in FIG. 1.

For example, as shown in FIG. 2B, in another example, the inverter sub-circuit may further comprise a fifth transistor T5. As shown in FIG. 2B, the gate electrode and the first electrode of the first transistor T1 are electrically connected to each other, and are configured to be both connected to the first voltage terminal VDD to receive the first voltage, and the second electrode of the first transistor T1 is connected to a gate electrode of the fifth transistor T5. The gate electrode of the fifth transistor T5 is configured to be connected to the second electrode of the first transistor T1, a first electrode of the fifth transistor T5 is configured to be connected to the first voltage terminal VDD, and a second electrode of the fifth transistor T5 is configured to be connected to the first node N1, that is, the second electrode of the fifth transistor T5 is connected to the first electrode of the second transistor T2 and a gate electrode of a third transistor T3 (to be described below).

The output control sub-circuit 120 can be implemented as the third transistor T3. The gate electrode of the third transistor T3 is configured to be connected to the first node N1, a first electrode of the third transistor T3 is configured to be connected to the third output terminal OUT3 and to a second electrode of a fourth transistor T4, and the second electrode of the third transistor T3 is configured to be connected to the common voltage terminal Vcom to receive the common voltage.

In order to enable the voltage of the first node N1 to be pulled down to the voltage at which the third transistor T3 is turned off when the second transistor T2 is turned on, it is necessary to select parameters (such as on-resistance) of the second transistor T2 and the first transistor T1 in the example as shown in FIG. 2A to enable that the voltage of the first node N1 is closer to the low voltage output by the second voltage terminal VSS; also it is necessary to select the parameters (such as on-resistance) of the second transistor 12 and the fifth transistor T5 in the example as shown in FIG. 2B to enable that the voltage of the first node N1 is closer to the low voltage output by the second voltage VSS.

The output sub-circuit 130 can be implemented as the fourth transistor T4. A gate electrode and a first electrode of the fourth transistor T4 are electrically connected to each other, and are configured to be connected to both the gate scanning signal receiving terminal Gate and the second output terminal OUT2, and the second electrode of the fourth transistor T4 is configured to be connected to the third output terminal OUT3.

In the above example, the first transistor T1, the second transistor T2, the third transistor T3, the fourth transistor T4, and the fifth transistor T5 are all described by taking an N-type transistor as an example. However, the embodiments of the present disclosure are not limited in this aspect, and these transistors each may be implemented at least partially by using a P-type transistor as needed.

Figure 3:
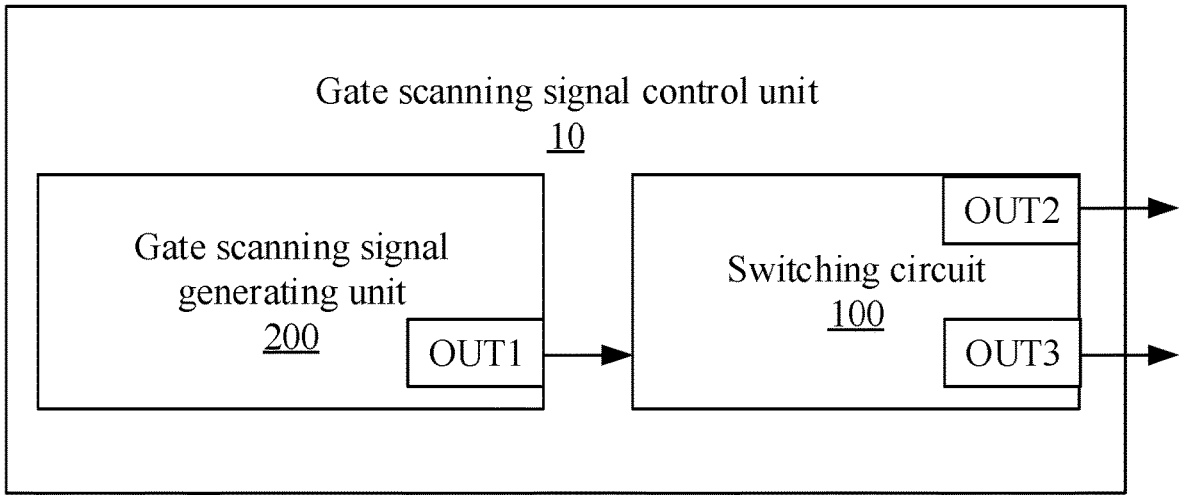
FIG. 3 is a schematic diagram of a gate scanning signal control circuit provided by an embodiment of the present disclosure.

FIG. 3 is a schematic diagram of a gate scanning signal control circuit provided by an embodiment of the present disclosure. As shown in FIG. 3, the gate scanning signal control circuit 10 comprises a switching circuit 100 and a gate scanning signal generating circuit 200. For example, the gate scanning signal generating circuit 200 may be one of cascaded shift register units or one of output ports of a gate driving integrated circuit chip.

For example, as shown in FIG. 3, the gate scanning signal generating circuit 200 comprises a first output terminal OUT1 configured to output a gate scanning signal. The switching circuit 100 comprises, for example, a gate scanning signal receiving terminal (not shown), a second output terminal OUT2, and a third output terminal OUT3. The gate scanning signal receiving terminal of the switching circuit 100 is connected to the first output terminal OUT1 of the gate scanning signal generating circuit 200 to receive the gate scanning signal, and the switching circuit 100 is configured to output the gate scanning signal to the second output terminal OUT2 and the third output terminal OUT3 simultaneously under the control of the gate scanning signal, for example, to control the gate scanning line electrically connected to both the second output terminal OUT2 and the common electrode line electrically connected to the third output terminal OUT3 in the display panel to transmit the gate scanning signal simultaneously, to reduce the transmission resistance of the gate scanning signal, thereby reducing the driving load of the gate scanning signal and improving the charging rate of the display panel.

With the gate scanning signal control circuit 10 provided by the embodiment of the present disclosure, in one aspect, the gate scanning signal is generated by the gate scanning signal generating circuit 200, and the gate line and the common electrode line are controlled to simultaneously transmit the gate scanning signal through the switching circuit 100, to reduce the transmission resistance of the gate scanning signal, thereby reducing the driving load of the gate scanning signal, and improving the charging rate of the display panel; on the other hand, during the period in which the gate scanning signal is not output, the transmission of the gate scanning signal can be separated from the transmission of the common voltage, the common electrode line transmits only the common voltage when the gate scanning signal is not output, thereby ensuring that the transmission of the gate scanning signal does not interfere with the transmission of the common voltage, and ensuring the normal display of the display panel.

For example, in an embodiment of the present disclosure, the gate scanning signal generating circuit 200 may comprise a shift register unit 200 configured for cascading. For example, the shift register unit 200 can be a shift register unit of GOA type.

Figure 4:
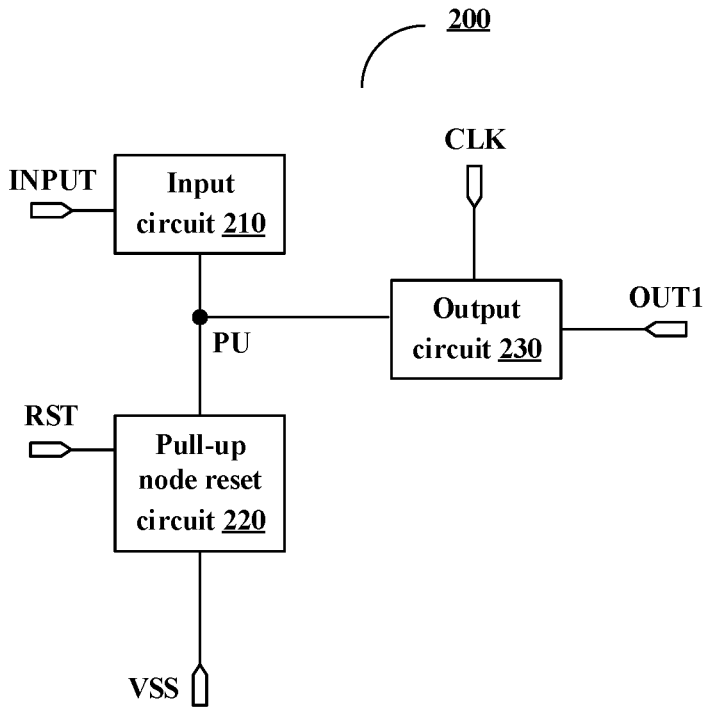
FIG. 4 is a schematic diagram of a shift register unit provided by an embodiment of the present disclosure.

For example, FIG. 4 is a schematic diagram of a shift register unit 200 provided by an embodiment of the present disclosure. As shown in FIG. 4, the shift register unit 200 comprises an input circuit 210, a pull-up node reset circuit 220, and an output circuit 230.

The input circuit 210 is configured to charge a pull-up node PU in response to an input signal. For example, the input circuit 210 can be connected to the input terminal INPUT and the pull-up node PU, and is configured to electrically connect the pull-up node PU and the input terminal INPUT or the additionally provided high-voltage terminal under the control of the signal input by the input terminal INPUT, so the high-level signal input by the input terminal INPUT or the high-level signal outputted by the high-voltage level terminal can be used to charge the pull-up node PU, so that the voltage of the pull-up node PU is increased to control the output circuit 230 to be turned on.

The pull-up node reset circuit 220 is configured to reset the pull-up node PU in response to a reset signal. For example, the pull-up node reset circuit 220 can be configured to be connected to a reset terminal RST, so the pull-up node PU can be electrically connected to the low-level signal or the low-voltage terminal under the control of the reset signal input by the reset terminal RST. The low voltage terminal is, for example, the second voltage terminal VSS, so the pull-up node PU can be pulled down and be reset.

The output circuit 230 is configured to output a clock signal input by the clock signal terminal CLK to the first output terminal OUT1 under control of the level of the pull-up node PU, and as an output signal of the shift register unit 200, and to be output to a switching circuit connected the first output terminal OUT1. For example, the output circuit 230 can be configured to be turned on under the control of the level of the pull-up node PU, to enable the clock signal terminal CLK to be electrically connected to the first output terminal OUT1, so that the clock signal input by the clock signal terminal CLK can be output to the first output terminal OUT1.

Figure 5:
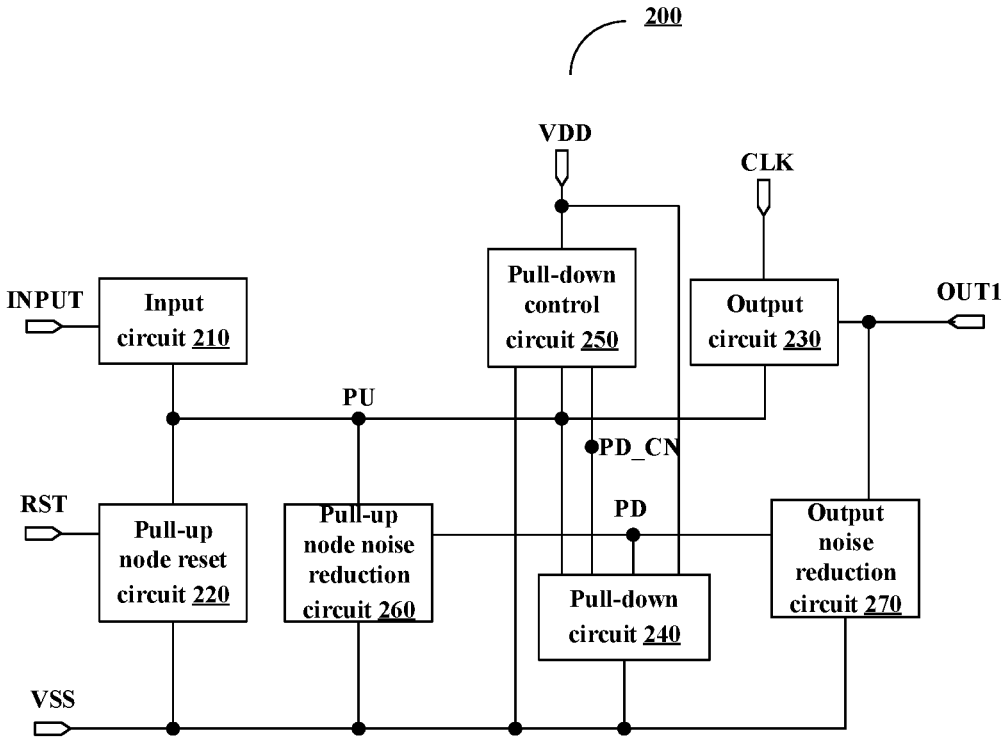
FIG. 5 is a schematic diagram of another shift register unit provided by an embodiment of the present disclosure.

For example, as shown in FIG. 5, in another example of an embodiment of the present disclosure, the shift register unit 200 may further comprise a pull-down circuit 240, a pull-down control circuit 250, a pull-up node noise reduction circuit 260, and an output noise reduction circuit 270.

The pull-down circuit 240 is configured to control the level of the pull-down node PD under the control of both the level of the pull-up node PU and the level of a pull-down control node PD_CN, thereby controlling the pull-up node noise reduction circuit 260 and the output noise reduction circuit 270.

For example, the pull-down circuit 240 can be connected to the first voltage terminal VDD, the second voltage terminal VSS, the pull-up node PU, the pull-down node PD, and the pull-down control node PD_CN, to enable the pull-down node PD to be electrically connected to the second voltage terminal VSS under the control of the level of the pull-up node PU, thereby pulling down the level of the pull-down node PD to be at a low potential. Also, the pull-down circuit 240 can be electrically connected to the pull-down node PD and the first voltage terminal VDD under the control of the level of the pull-down control node PD_CN, thereby charging the pull-down node PD to be at a high potential.

The pull-down control circuit 250 is configured to control the level of the pull-down control node PD_CN under the control of the level of the pull-up node PU. For example, the pull-down control circuit 250 can be connected to the first voltage terminal VDD, the second voltage terminal VSS, the pull-up node PU, and the pull-down control node PD_CN, to enable the pull-down control node PD_CN to be electrically connected the second voltage terminal VSS under the control of the level of the pull-up node PU, thereby controlling the level of the pull-down control node PD_CN.

The pull-up node noise reduction circuit 260 is configured to reduce noise of the pull-up node PU under the control of the level of the pull-down node PD. For example, the pull-up node noise reduction circuit 260 can be configured to be connected to the second voltage terminal VSS, to enable the pull-up node PU to be electrically connected to the second voltage terminal VSS under the control of the level of the pull-down node PD, thereby performing pull-down and noise reduction upon the pull-up node PU.

The output noise reduction circuit 270 is configured to reduce noise of the first output terminal OUT1 under the control of the level of the pull-down node PD. For example, the output noise reduction circuit 270 can be configured to enable the first output terminal OUT1 to be electrically connected to the second voltage terminal VSS under the control of the level of the pull-down node PD, thereby performing pull-down and noise reduction upon the first output terminal OUT1.

Figure 6:
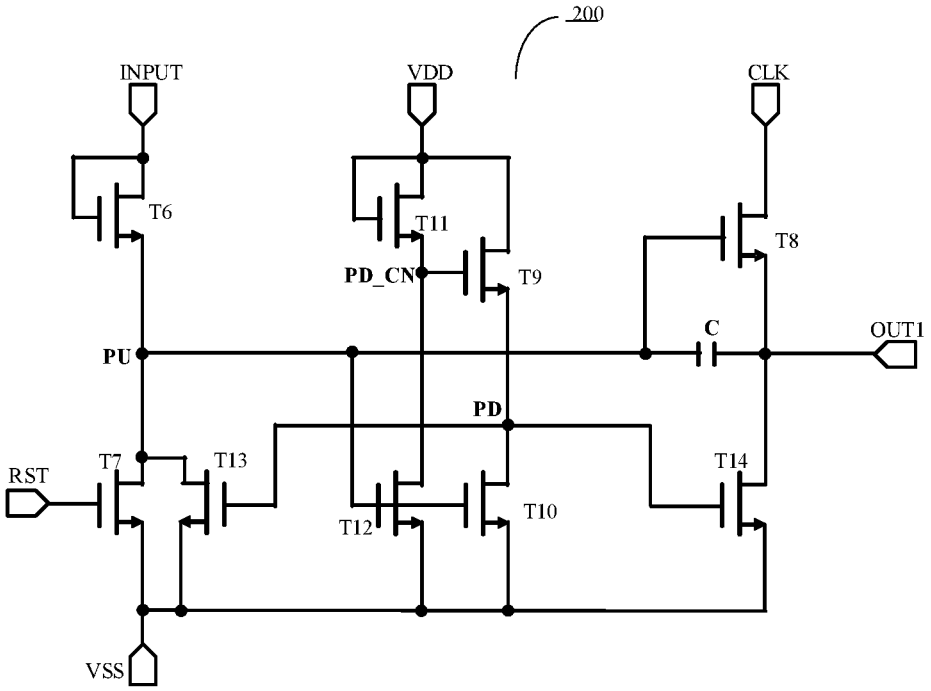
FIG. 6 is a circuit diagram of the shift register unit as shown in FIG. 5.

For example, the shift register unit 200 as shown in FIG. 5 may be specifically implemented as the circuit structure as shown in FIG. 6 in one example. In the following description, each transistor can be described by taking an N-type transistor as an example, but it does not constitute a limitation on the embodiment of the present disclosure.

The input circuit 210 can be implemented as a sixth transistor T6. A gate electrode and a first electrode of the sixth transistor T6 are electrically connected to each other, and are configured to be both connected to the input terminal INPUT to receive an input signal, and a second electrode of the sixth transistor T6 is configured to be connected to the pull-up node PU, so a turn-on signal can be used to charge the pull-up node PU to be a high potential when the sixth transistor T6 is turned on due to the turn-on signal (high level signal) received by the input terminal INPUT.

The pull-up node reset circuit 220 can be implemented as a seventh transistor T7. A gate electrode of the seventh transistor T7 is configured to be connected to the reset terminal RST to receive the reset signal, a first electrode of the seventh transistor T7 is configured to be connected to the pull-up node PU, and a second electrode of the seventh transistor T7 is configured to be connected to the second voltage terminal VSS to receive the second voltage. When the seventh transistor T7 is turned on by the reset signal, the pull-up node PU can be electrically connected to the second voltage terminal VSS, so the pull-up node PU can be reset to fall from the high level to the low level.

The output circuit 230 can be implemented to comprise an eighth transistor T8 and a storage capacitor C. A gate electrode of the eighth transistor T8 is configured to be connected to the pull-up node PU, and a first electrode of the eighth transistor T8 is configured to be connected to the clock signal terminal CLK to receive the clock signal, and a second electrode of the eighth transistor T8 is configured to be connected to the first output terminal OUT1; and a first electrode of the storage capacitor C is configured to be connected to the gate electrode of the eighth transistor T8, and a second electrode of the storage capacitor C is connected to the second electrode of the eighth transistor T8.

The pull-down circuit 240 can be implemented to comprise a ninth transistor T9 and a tenth transistor T10. A gate electrode of the ninth transistor T9 is configured to be connected to the pull-down control node PD_CN, a first electrode of the ninth transistor T9 is configured to be connected to the first voltage terminal VDD to receive the first voltage, and a second electrode of the ninth transistor T9 is configured to be connected to the pull-down node PD; and a gate electrode of the tenth transistor T10 is configured to be connected to the pull-up node PU, and a first electrode of the tenth transistor T10 is configured to be connected to the pull-down node PD, and a second electrode of the tenth transistor T10 is configured to be connected to the second voltage terminal VSS to receive the second voltage.

The pull-down control circuit 250 can be implemented to comprise an eleventh transistor T11 and a twelfth transistor T12. A gate electrode of the eleventh transistor T11 and a first electrode of the eleventh transistor T11 are electrically connected to each other, and are configured to be both connected to the first voltage terminal VDD to receive the first voltage, and a second electrode of the eleventh transistor T11 is configured to be connected to the pull-down control node PD_CN; and a gate electrode of the twelfth transistor T12 is configured to be connected to the pull-up node PU, a first electrode of the twelfth transistor T12 is configured to be connected to the pull-down control node PD_CN, and a second electrode of the twelfth transistor T12 is configured to be connected to the second voltage terminal VSS to receive the second voltage.

The pull-up node noise reduction circuit 260 can be implemented as the thirteenth transistor T13. A gate electrode of the thirteenth transistor T13 is configured to be connected to the pull-down node PD, a first electrode of the thirteenth transistor T13 is configured to be connected to the pull-up node PU, and a second electrode of the thirteenth transistor T13 is configured to be connected to the second voltage terminal VSS to receive the second voltage. The thirteenth transistor T13 is turned on when the pull-down node PD is at a high potential, and can enable the pull-up node PU to be connected to the second voltage terminal VSS, so the pull-up node PU can be pulled down to achieve noise reduction.

The output noise reduction circuit 270 can be implemented as a fourteenth transistor T14. A gate electrode of the fourteenth transistor T14 is configured to be connected to the pull-down node PD, a first electrode of the fourteenth transistor T14 is configured to be connected to the first output terminal OUT1, and a second electrode of the fourteenth transistor T14 is configured to be connected to the second voltage terminal VSS to receive the second voltage. The fourteenth transistor T14 is turned on when the pull-down node PD is at a high potential, and can enable the first output terminal OUT1 to be connected to the second voltage terminal VSS, so the noise at the first output terminal OUT1 can be reduced.

It should be noted that the transistors used in the embodiments of the present disclosure may all be thin film transistors or field effect transistors or other switching devices with the like characteristics, and the embodiments of the present disclosure can be described by taking the thin film transistor as an example. A source electrode and a drain electrode of the transistor used here can be symmetrical in structure, so the source electrode and the drain electrode of the transistor can be structurally indistinguishable. In the embodiment of the present disclosure, in order to distinguish the two electrodes of the transistor except the gate electrode, one of the electrodes is referred to as the first electrode described directly, and the other is referred to as the second electrode.

In addition, the transistors in the embodiments of the present disclosure are all described by taking an N-type transistor as an example. In this case, a first electrode of the transistor is the drain electrode, and a second electrode is the source electrode. It should be noted that the present disclosure includes but is not limited in this aspect. For example, one or more transistors in the shift register unit provided by the embodiment of the present disclosure may also adopt a P-type transistor. In this case, the first electrode of the transistor is the source electrode, the second electrode is the drain electrode, and as long as the polarities of the electrodes of transistors selected type correspondingly be connected in accordance with the polarities of the respective electrodes of the respective transistors in the embodiment of the present disclosure.

For example, as shown in FIG. 6, the transistors in the shift register unit 200 all adopt an N-type transistor, and the first voltage terminal VDD continues to input a first voltage of a DC high level, and the second voltage terminal VSS continues to input the second voltage of a DC low level, the clock signal terminal CLK inputs the clock signal, and the common voltage terminal Vcom inputs the common voltage.

Figure 7:
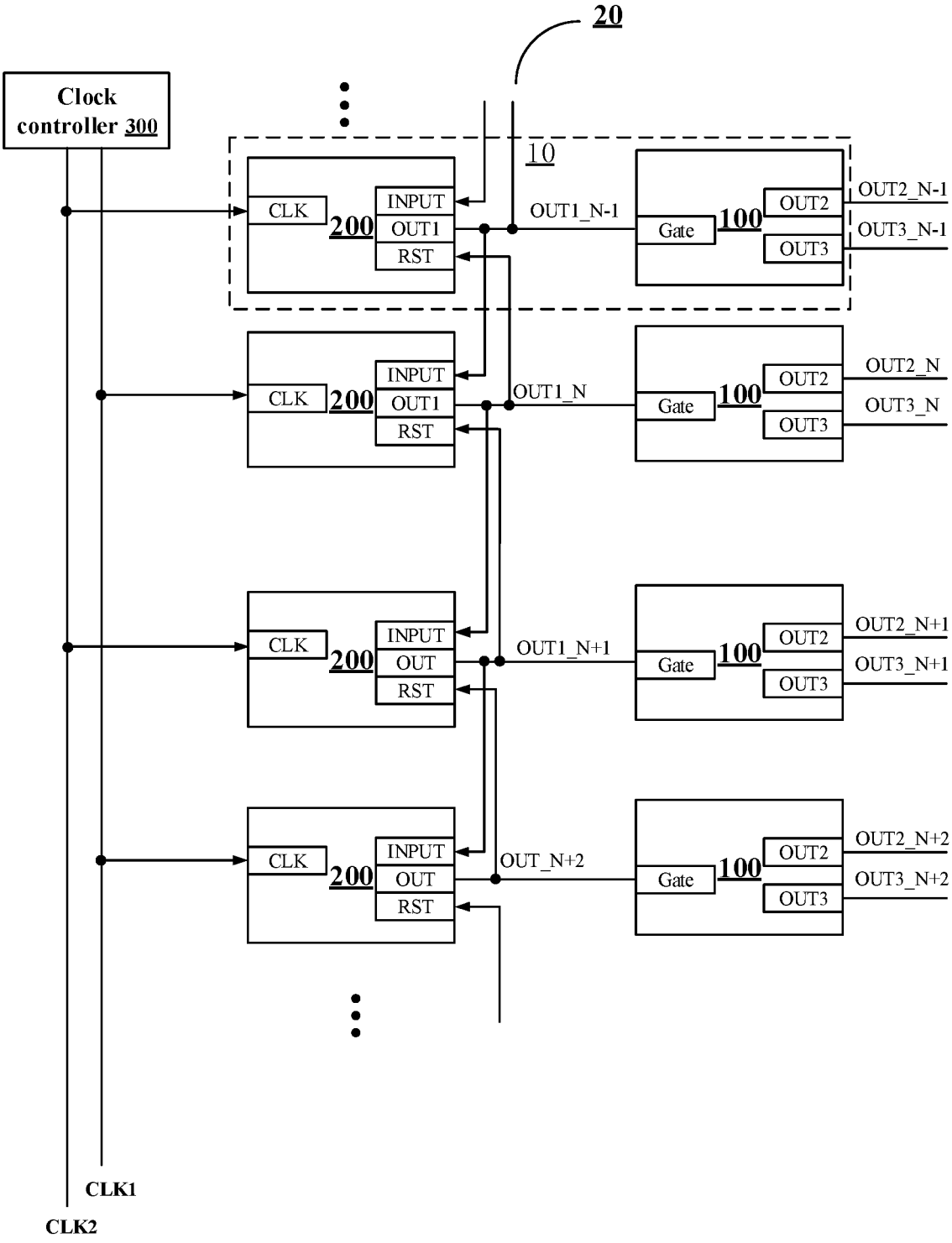
FIG. 7 is a schematic diagram of a gate driving circuit provided by an embodiment of the present disclosure.

Embodiments of the present disclosure provide a gate driving circuit 20, For example, as shown in FIG. 7, one example of an embodiment of the present disclosure provides a gate driving circuit 20 comprising a plurality of cascaded gate scanning signal control circuits 10, a first clock signal line CLK1 and a second clock signal line CLK2. For example, each of the gate scanning signal control circuits 10 comprises a shift register unit 200 configured for cascading and a switching circuit 100 connected to the first output terminal OUT1 of the shift register unit 200. It should be noted that the gate driving circuit may further comprise four, six or eight clock signal lines, and the number of the clock signal lines is determined according to a specific situation, and the embodiment of the present disclosure is not limited in this aspect here.

For example, as shown in FIG. 7, each of the shift register units 200 further comprises a clock signal terminal CLK, and is configured to be connected to the first clock signal line CLK1 or the second clock signal line CLK2 to receive a first clock signal or a second clock signal. The first clock signal line CLK1 is connected to the clock signal terminal CLK of the (2n−1)th (n is an integer greater than 0) stage shift register unit, and the second clock signal line CLK2 is connected to the clock signal terminal CLK of the 2nth stage shift register unit. It should be noted that the embodiments of the present disclosure comprise, but are not limited to the foregoing connection manner, for example, it is also possible to adopt the connection manner that: the first clock signal line CLK1 is connected to the clock signal terminal CLK of the (2n)th stage shift register unit, the second clock signal line CLK2 is connected to the clock signal terminal CLK of the (2n−1)th stage shift register unit.

It should be noted that, as shown in FIG. 7, OUT1_N−1 represents the first output terminal of the (N−1)th stage shift register unit, and OUT1_N represents the first output terminal of the Nth stage shift register unit, and OUT1_N+1 represents the first output terminal of the (N+1)th shift register unit, OUT1_N+2 represents the first output terminal of the (N+2)th stage shift register unit. As shown in FIG. 7, OUT2_N−1 represents the second output terminal of the (N−1)th stage switching circuit, and OUT2_N represents the second output terminal of the Nth stage switching circuit, and OUT2_N+2 represents the second output of the (N+2)th stage switching circuit. As shown in FIG. 7, OUT3_N−1 represents the third output terminal of the (N−1)th stage switching circuit, and OUT3_N represents the third output terminal of the Nth stage switching circuit, and OUT3_N+1 represents the third output terminal of the (N+1)th stage switching circuit, and OUT3_N+2 represents the third output terminal of the (N+2)th stage switching circuit. The drawing numerals in the following embodiments are similar to this and will not be described again.

For example, as shown in FIG. 7, except for the last stage shift register unit, the reset terminals RST of the remaining stages shift register units are connected to the first output terminal OUT1 of the next stage shift register unit. Except for the first stage shift register unit, the input terminals INPUT of the remaining stages shift register units are connected to the first output terminal OUT1 of the previous stage shift register unit.

For example, the input terminal INPUT of the first stage shift register unit can be configured to receive a trigger signal STV, and the reset terminal RST of the last stage shift register unit can be configured to receive a reset signal RESET. The trigger signal STV and the reset signal RESET are not as shown in FIG. 7 for the sake of simplicity.

For example, as shown in FIG. 7, the gate driving circuit 20 may further comprise a clock controller 300. For example, the clock controller 300 can be configured to be connected to the first clock signal line CLK1 and the second clock signal line CLK2 to provide clock signals to each of the shift register units. For example, the clock controller 300 can be configured to be connected to a common electrode line (not shown) to provide a common voltage to each stage gate scanning signal control circuit 10. For example, the clock controller 300 can also be configured to provide the trigger signal STV and the reset signal RESET.

Figure 8:
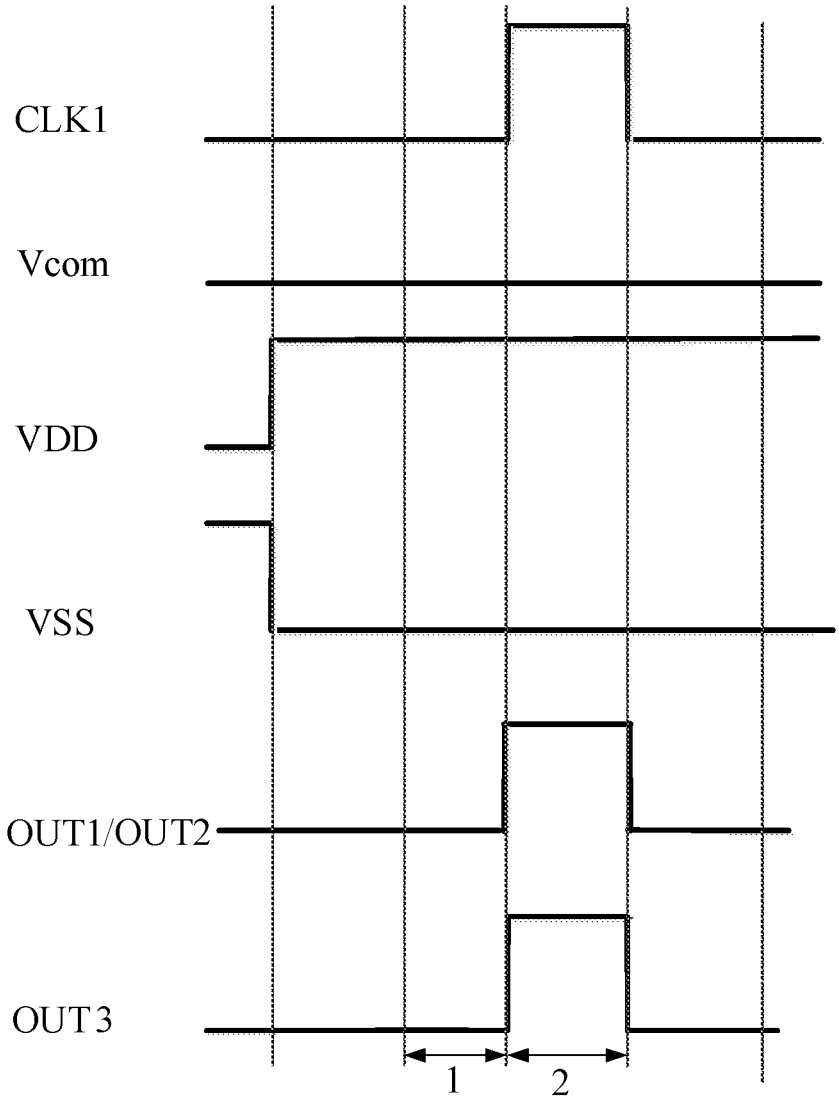
FIG. 8 is a timing diagram of signals corresponding to the gate driving circuit in operation as shown in FIG. 7.

For example, clock signal timings (not as shown in FIG. 8) provided by the first clock signal line CLK1 and the second clock signal line CLK2 may adopt the signal timing as shown in FIG. 8 to implement the function that the gate driving circuit 20 output the gate scanning signal row by row.

The operation principle of the gate driving circuit 20 as shown in FIG. 7 will be described below with reference to the signal timing diagram as shown in FIG. 8. As shown in FIG. 8, the turn-on level of the gate scanning signal is a high level, and the turn-off level is a low level. In the two phases of the first phase 1 and the second phase 2 as shown in FIG. 8, the gate driving circuit 20 can perform the following operations, respectively. For example, the embodiment of the present disclosure can be described by taking the operation principle of the Nth stage gate scanning signal control circuit in the gate driving circuit 20 as an example, and the operation principle of the remaining stages gate scanning signal control circuits is similar to the operation principle of the Nth stage gate scanning signal control circuit, and is not repeated here.

It should be noted that, as shown in FIG. 8, in the present example, the first phase 1 is a phase in which the gate scanning signal is not output, and the second phase 2 is a phase in which the gate scanning signal is output. In the second phase 2, the gate scanning signal is simultaneously outputted to the second output terminal OUT2 and the third output terminal OUT3 under the control of the gate scanning signal.

Figure 9:
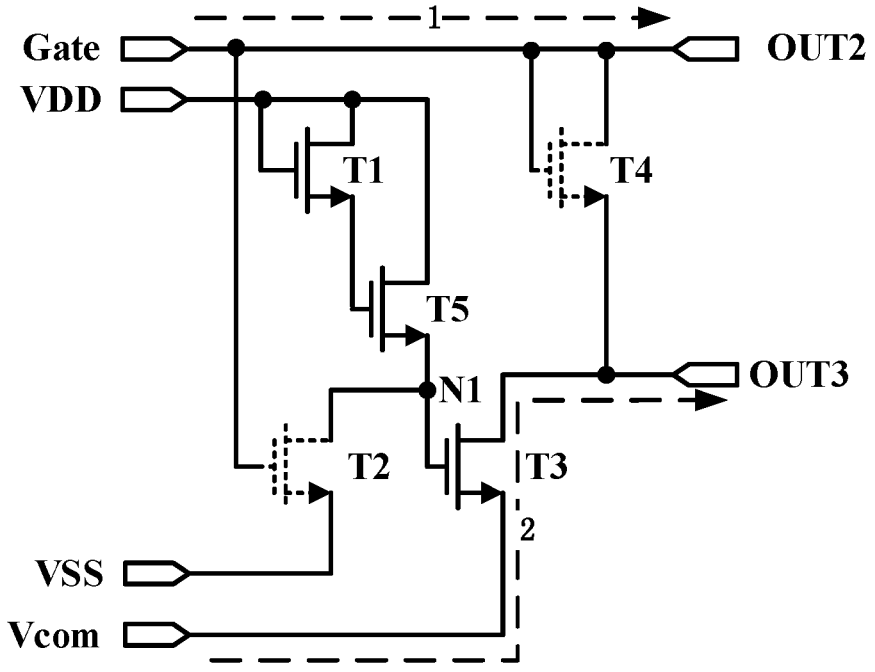
FIG. 9 and FIG. 10 are a circuit schematic diagram of the switching circuit as shown in FIG. 2B corresponding to FIG. 8 respectively.
Figure 10:
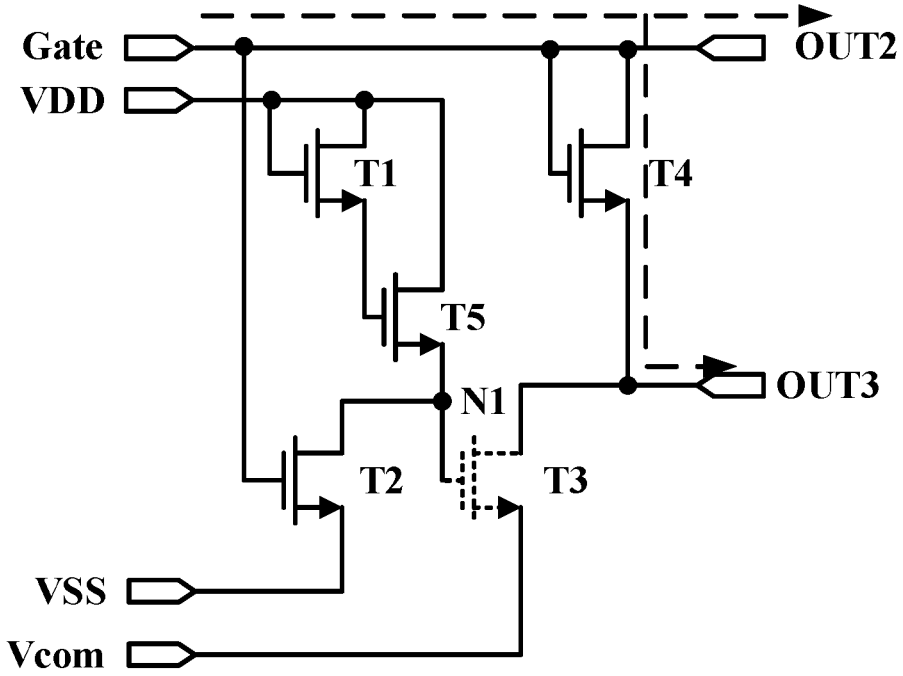

It should be noted that FIG. 9 is a schematic diagram of the switching circuit 100 as shown in FIG. 2B in the first phase 1, and FIG. 10 is a schematic diagram of the switching circuit 100 as shown in FIG. 2B in the second phase 2. In addition, the transistors identified by dashed lines as shown in FIG. 9 and FIG. 10 all represent that these transistors are in a turn-off state during the corresponding phase, and the dashed arrows in FIG. 9 and FIG. 10 indicate the direction of current flows in the corresponding phase of the switching circuit. The transistors as shown in FIG. 9 and FIG. 10 are all described by taking an N-type transistor as an example, that is, the gate electrodes of the respective transistors are turned on when they are received a high level, and are turned off when they are received a low level.

In the first phase 1, the first clock signal line CLK1 provides a low level signal, because the clock signal terminal CLK of the Nth stage shift register unit 200 is connected to the first clock signal line CLK1, so during this phase, the clock signal terminal CLK of the Nth stage shift register unit 200 inputs a low level signal; further, because the pull-up node PU_N of the Nth stage shift register unit 200 is at a high level, so under the control of the high level the pull-up node PU_N, the low level signal input by the clock signal terminal CLK is output to the first output terminal OUT1_N of the Nth stage shift register unit 200. For example, the low level signal is referred to as a first level, that is, d this phase, the first output terminal OUT1_N of the Nth stage shift register unit 200 and the second output terminal OUT2_N of the switching circuit 100 output the first level of the gate scanning signal. It should be noted that the level of the potential of the signal timing diagram as shown in FIG. 8 is only illustrative and does not represent a true potential value or indicate any relative ratio between the signals, and corresponding to the above example, the high level signal corresponds to the turn-on signal of the N-type transistor, and the low level signal corresponds to the turn-off signal of the N-type transistor.

As shown in FIGS. 8 and 9, in the first phase 1, the first transistor T1 and the fifth transistor T5 are turned on in response to the first voltage provide by the first voltage terminal VDD, and the third transistor T3 is turned on in response to the high level of the first node N1, and at the same time, the second transistor T2 and the fourth transistor T4 are turned off under the control of the low level of the gate scanning signal.

As shown in FIG. 9, in the first phase, the switching circuit 100 as shown in FIG. 2B forms an output path of the gate scanning signal (as indicated by a broken line 1 with an arrow as shown in FIG. 9) and an output path of the common voltage (as indicated by a broken line 2 with an arrow as shown in FIG. 9). Because the level of the first node N1 is at a high level during this phase, the third transistor T3 is turned on in response to the high level of the first node N1, and the third output terminal OUT3 is connected to the common voltage terminal Vcom, so during this phase, the third output terminal OUT3 of the switching circuit 100 outputs a common voltage; at the same time, during this phase, the first output terminal OUT1 of the shift register unit 200 outputs a low level of the gate scanning signal, and the gate scanning signal receiving terminal Gate is connected to the first output terminal OUT1 of the shift register unit 200, so the gate scanning signal receiving terminal Gate inputs the low level of the gate scanning signal; further, because the second output terminal OUT2 is connected to the gate scanning signal receiving terminal Gate, during this phase, the second output terminal OUT2 of the switching circuit 100 outputs a low level of the gate scanning signal.

In the second phase 2, the first clock signal line CLK1 provides a high level signal, and because the clock signal terminal CLK of the Nth stage shift register unit 200 is connected to the first clock signal line CLK1, so during this phase, the clock signal terminal CLK of the Nth stage shift register unit 200 inputs a high level signal; further, because the pull-up node PU_N of the Nth stage shift register unit 200 is at a high level, so under the control of the high level of the pull-up node PU_N, the high level signal input by the clock signal terminal CLK is output to the first output terminal OUT1_N of the Nth stage shift register unit 200, for example, the high level signal is referred to as a second level, that is, during this phase, the Nth stage shift register unit 200 outputs the second level of the gate scanning signal.

As shown in FIG. 8 and FIG. 9, in the second phase 2, the first transistor T1 and the fifth transistor T5 are turned on under the control of the first voltage supplied from the first voltage terminal VDD, the second transistor T2 and the fourth transistor T4 are turned on under the control of the high level of the gate scanning signal, and the third transistor T3 is turned off under the control of the level of the first node N1.

As shown in FIG. 9, in the second phase, an output path of the gate scanning signal is formed (as indicated by a broken line with an arrow as shown in FIG. 9). During this phase, because the fourth transistor T4 is turned on in response to the high level of the gate scanning signal, the second output terminal OUT2 and the third output terminal OUT3 are both connected to the gate scanning signal receiving terminal Gate, so during this phase, the second output terminal OUT2 and the third output terminal OUT3 of the switching circuit 100 output the gate scanning signal.

It should be noted that when the gate driving circuit 20 provided by the embodiment of the present disclosure is used to drive a display panel, the gate driving circuit 20 may be provided on either side or both sides of the display panel. For example, the display panel comprises a multiple rows of gate lines and a multiple rows of common electrode lines. The second output terminals of the stage switching circuits of the bilateral (both-side) gate driving circuit can be configured to be sequentially connected to the multiple rows of gate lines, and the third output terminals of the stage switching circuits of the bilateral gate driving circuit can be configured to be sequentially connected to the multiple rows of common electrode lines, for outputting the gate scanning signals when the gate scanning signals are output, and outputting a common voltage when the gate scanning signals are not output.

The gate driving circuit 20 provided in this embodiment can simultaneously drive the same gate line and the same common electrode line with the bilateral driving circuit configuration, so the gate line and the common electrode line can simultaneously transmit the gate scanning signal.

For example, when only the gate line transmits the gate scanning signal, the transmission resistance of the gate scanning signal, that is, the resistance of the gate line, is represented as $R_{Gate}$; when the bilateral driving circuit simultaneously drives the gate line and the common electrode line to transmit the gate scanning signal, the transmission resistance of the gate scanning signal is expressed as:

$$R = \frac{1}{\frac{1}{R_{Gate}} + \frac{1}{R_{Vcom}}}$$

where $R_{Gate}$ is represented as the resistance value of the gate line, $R_{Vcom}$ is represented as the resistance value of the common electrode line.

It can be seen that the gate driving circuit 20 can reduce the transmission resistance of the gate scanning signal, and reduce the driving load of the gate scanning signal, and improve the charging rate of the display panel.

Figure 11:
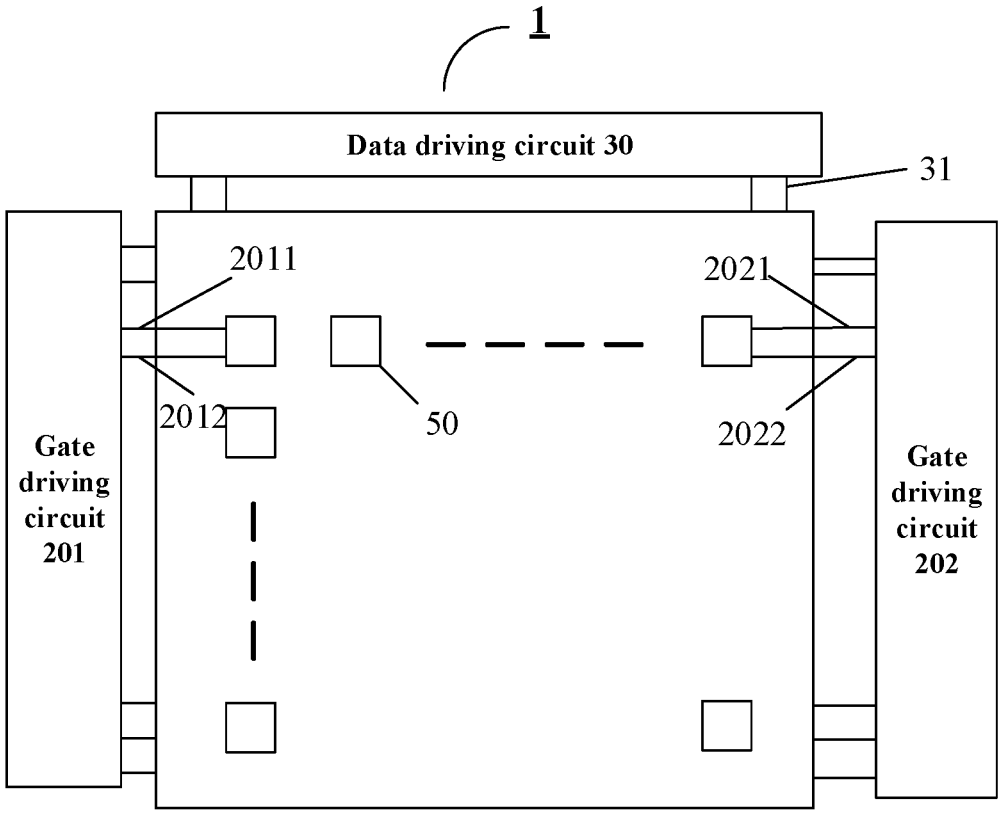
FIG. 11 is a schematic diagram of a display device provided by an embodiment of the present disclosure.

An embodiment of the present disclosure further provides a display device 1. As shown in FIG. 11, the display device 1 comprises the gate driving circuit 20 provided by the embodiments of the present disclosure. For example, the gate driving circuit 20 is a bilateral driving circuit, and comprises, for example, a first side driving circuit 201 and a second side driving circuit 202. For example, the first side driving circuit 201 and the second side driving circuit 202 are directly prepared on an array substrate of the display device 1, and, for example, in the case where the transistors used by the display device 1 are N-type transistors, the N-type transistors each can be such as a hydrogenated amorphous silicon thin film transistor, a low temperature polysilicon thin film transistor, or the like. The display device 1 comprises a pixel array including a plurality of pixel units 50 arranged in an array. For example, the display device 1 may further comprise a data driving circuit 30. The data driving circuit 30 is configured to provide a set of data signals to the pixel array; the first side driving circuit 201 and the second side driving circuit 202 are configured to simultaneously provide a gate scanning signal outputted due to a same clock signal to a same gate line of the pixel array. The data driving circuit 30 is electrically connected to the pixel unit 50 through the data lines 31. For example, the display device 1 may further comprise a plurality of gate lines and a plurality of common electrode lines. The pixel units 50 in each row are connected to the same gate line and the same common electrode line, and the same gate line and the same common electrode line are electrically connected to the second output terminal OUT2 and the third output terminal OUT3 of the gate scanning signal control circuit corresponding to one row of the pixel units, respectively. For example, the second output terminal OUT2 of the first side driving circuit 201 is electrically connected to the pixel units 50 in one row through the gate line 2011, and the third output terminal OUT3 of the first side driving circuit 201 is electrically connected to the pixel units 50 in the row through the common electrode line 2012, and the second output terminal OUT2 of the second side driving circuit 202 is electrically connected to the pixel units 50 in the row through the gate line 2021, and the third output terminal OUT3 of the second side driving circuit 202 is electrically connected to the pixel units 50 in the row through the common electrode line 2022; and the pixel units in each row share the same gate line and share the same common electrode line. That is, the gate line 2011 and the gate line 2021 that drive the pixel unit in the same row are the same gate line, and the common electrode line 2012 and the common electrode line 2022 that drive the pixel unit in the same row are the same common electrode line, and the first side driving circuit 201 and the second side driving 202 of the bilateral driving circuit are capable of driving gate lines in rows simultaneously. For example, the first side driving circuit 201 is completely identical to the second side driving circuit 202 in configuration, and they are configured to simultaneously output gate scanning signals to the gate lines and the common electrode lines respectively connected the first side driving circuit 201 and the second side driving circuit 202 through the same clock signals.

Figure 12:
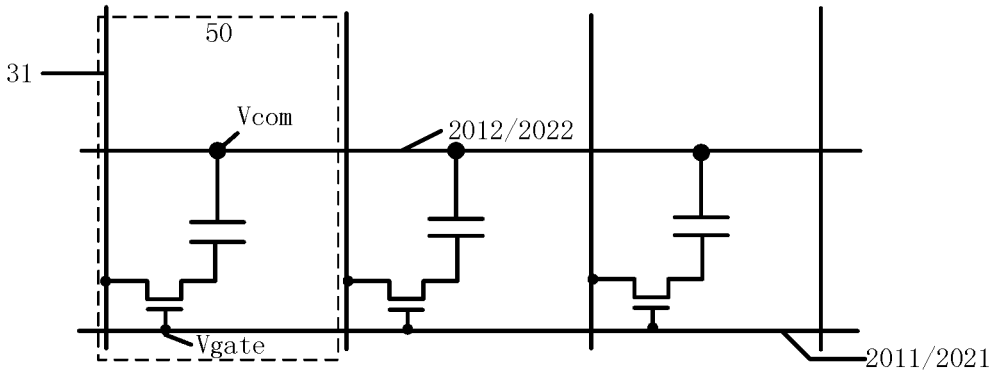
FIG. 12 is a schematic diagram of a pixel unit in the display device as shown in FIG. 11.

For example, as shown in FIG. 12, the control terminals Vgate of the transistors of the pixel units in one row are connected to the same gate line 2011/2021, and the common signal terminals Vcom of the pixel units in one row are connected to the same common electrode line 2012/2022, the pixel units in each column is connected to the same data line 31 to provide a data signal. For example, one terminal of the gate line 2011/2012 and one terminal the common electrode line 2012/2022 are respectively connected to the second output terminal OUT2 and the third output terminal OUT3 of one stage switching circuit of the first side driving circuit 201 (not as shown in FIG. 12), and the other terminals thereof are connected to the second output terminal OUT2 and the third output terminal OUT3 of the same stage switching circuit of the second side driving circuit 202 (not as shown in FIG. 12). Therefore, when the gate line and the common electrode line of the bilateral driving circuit simultaneously transmit the gate scanning signal, the transmission resistance of the gate scanning signal is expressed as:

$$R = \frac{1}{\frac{1}{R_{Gate}} + \frac{1}{R_{Vcom}}}$$

where $R_{Gate}$ is represented as the resistance value of the gate line, $R_{Vcom}$ is represented as the resistance value of the common electrode line.

When only the gate line transmits the gate scanning signal, the transmission resistance of the gate scanning signal is the resistance of the gate line $R_{Gate}$, so it can be seen that the gate driving circuit 20 can reduce the transmission resistance of the gate scanning signal, and reduce the driving load of the gate scanning signal, and improve the charging rate of the display panel.

It should be noted that the display device 1 in this embodiment may be any product or component with display function such as: LCD panel, LCD TV, display, OLED panel. OLED TV, electronic paper display device, mobile phone, tablet computer, notebook computer, digital photo frame, navigator or the like. The display device 1 may further comprise other conventional components such as a display panel, which is not limited by the embodiments of the present disclosure.

The technical effects of the display device 1 provided by the embodiments of the present disclosure can be referred to the corresponding description of the gate driving circuit 20 in the above embodiment, and details are not described herein again.

It should be noted that the entire structure of the display device 1 is not given for clarity and conciseness. In order to realize the necessary functions of the display device, one skilled in the art may set other structures not as shown in FIG. 12 according to a specific application scenario, which is not limited in the embodiments of the present disclosure.

For example, an embodiment of the present disclosure provides a driving method for, such as a gate driving circuit of a display device, which can comprise the following operations:

The gate scanning signal is output to the second output terminal OUT2 and the third output terminal OUT3 simultaneously under the control of the gate scanning signal. For example, when the gate scanning signal is at a first level (e.g., an turn-on level, such as a low level), the third output terminal OUT3 of the switching circuit 100 outputs a common voltage; when the gate scan signal is at a second level (e.g., a turn-off level, such as a high level), the second output terminal OUT2 and the third output terminal OUT3 of the switching circuit 100 output a gate scanning signal simultaneously.

Further, for the example as shown in FIG. 2A, the operation that the third output terminal OUT3 of the switching circuit 100 outputs a common voltage when the gate scanning signal is at the first level comprises that: the first transistor T1 is turned on in response to the first level, and the third transistor T3 is turned on under the control of the level of the first node N1, and the second transistor T2 and the fourth transistor T4 are turned off under the control of the first level; the operation that, when the gate scanning signal is at the second level, the second output terminal OUT2 and the third output terminal OUT3 of the switch circuit 100 output a gate scanning signal, comprises that: the first transistor T1 is turned on under the control of the first voltage, the second transistor T2 and the fourth transistor T4 are turned on under the control of the second level, and the third transistor T3 is turned off under the control of the level of the first node N1.

Further, for the example shown in FIG. 2B, the operation that the third output terminal OUT3 of the switching circuit 100 outputs a common voltage when the gate scanning signal is at the first level comprises that: the first transistor T1 and the fifth transistor T5 are turned on in response to the first level, and the third transistor T3 is turned on under the control of the level of the first node N1, and the second transistor T2 and the fourth transistor T4 are turned off under the control of the first level; the operation that, when the gate scanning signal is at the second level, the second output terminal OUT2 and the third output terminal OUT3 of the switch circuit 100 output a gate scanning signal, comprises that: the first transistor T1 and the fifth transistor T5 are turned on under the control of the first voltage, the second transistor T2 and the fourth transistor T4 are turned on under the control of the second level, and the third transistor T3 is turned off under the control of the level of the first node N1.

The technical effects of the driving method of the gate driving circuit 20 provided by the embodiment of the present disclosure can be referred to the corresponding description of the gate driving circuit 20 in the above embodiment, and details are not described herein again.

There are a few points to note:

(1) The drawings of the present disclosure relate only to the structure related to the embodiment of the present disclosure, and other structures can be referred to the general design.

(2) In the case of no conflict, the features of the embodiments and the embodiments of the present disclosure may be combined with each other to obtain a new embodiment.

What are described above is related to the illustrative embodiments of the disclosure only and not limitative to the scope of the disclosure, the scopes of the disclosure are defined by the accompanying claims.

What is claimed is:

1. A switching circuit, comprising a gate scanning signal receiving terminal, a second output terminal, a third output terminal, an inverter sub-circuit, an output control sub-circuit, and an output sub-circuit;

wherein the gate scanning signal receiving terminal of the switching circuit is configured to receive a gate scanning signal, and the switching circuit is configured to output the gate scanning signal to the second output terminal and the third output terminal simultaneously under control of the gate scanning signal;

the inverter sub-circuit is configured to control a level of a first node in the switching circuit under control of the gate scanning signal;

the output control sub-circuit is configured to transmit a common voltage input by a common voltage terminal to the third output terminal under control of the level of the first node; and the output sub-circuit is configured to output the gate scanning signal to both the second output terminal and the third output terminal simultaneously under control of the gate scanning signal.

2. The switching circuit according to claim 1, wherein the inverter sub-circuit comprises:

a first transistor, wherein a gate electrode of the first transistor is connected to a first electrode of the first transistor and is configured to be connected to a first voltage terminal to receive a first voltage, and a second electrode of the first transistor is connected to the first node; and a second transistor, wherein a gate electrode of the second transistor is configured to be connected to the gate scanning signal receiving terminal to receive the gate scanning signal, a first electrode of the second transistor is configured to be connected to the first node, and a second electrode of the second transistor is configured to be connected to a second voltage terminal to receive a second voltage.

3. The switching circuit according to claim 1, wherein the output control sub-circuit comprises:

a third transistor, wherein a gate electrode of the third transistor is configured to be connected to the first node, a first electrode of the third transistor is configured to be connected to the third output terminal, and a second electrode of the third transistor is configured to be connected to the common voltage terminal to receive the common voltage.

4. The switching circuit according to claim 1, wherein the output sub-circuit comprises:

a fourth transistor, wherein a gate electrode and a first electrode of the fourth transistor are electrically connected to each other, and are configured to be both connected to the gate scanning signal receiving terminal and the second output terminal, and a second electrode of the fourth transistor is configured to be connected to the third output terminal.

5. The switching circuit according to claim 1, wherein the inverter sub-circuit comprises:

a first transistor, a second transistor, and a fifth transistor, wherein a gate electrode and a first electrode of the first transistor are electrically connected to each other and are configured to be both connected to a first voltage terminal to receive a first voltage, and a second electrode of the first transistor is connected to a gate electrode of the fifth transistor;

a gate electrode of the second transistor is configured to be connected to the gate scanning signal receiving terminal to receive the gate scanning signal, a first electrode of the second transistor is configured to be connected to the first node, and a second electrode of the second transistor is configured to be connected to a second voltage terminal to receive a second voltage; and the gate electrode of the fifth transistor is configured to be connected to the second electrode of the first transistor, a first electrode of the fifth transistor is configured to be connected to the first voltage terminal, and a second electrode of the fifth transistor is configured to be connected to the first node.

6. A gate scanning signal control circuit, comprising the switching circuit according to claim 1 and a gate scanning signal generating circuit;

wherein the gate scanning signal generating circuit comprises a first output terminal, and the first output terminal is configured to output the gate scanning signal; and the gate scanning signal receiving terminal of the switching circuit is connected to the first output terminal to receive the gate scanning signal.

7. The gate scanning signal control circuit according to claim 6, wherein the gate scanning signal generating circuit comprises a shift register unit configured for cascading.

8. The gate scanning signal control circuit according to claim 7, wherein the shift register unit comprises an input circuit, a pull-up node reset circuit, and an output circuit;

wherein the input circuit is configured to charge a pull-up node in response to an input signal;

the pull-up node reset circuit is configured to reset the pull-up node in response to a reset signal; and the output circuit is configured to output a clock signal to the first output terminal under control of a level of the pull-up node.

9. The gate scanning signal control circuit according to claim 8, wherein the shift register unit further comprises a pull-down circuit, a pull-down control circuit, a pull-up node noise reduction circuit, and an output noise reduction circuit;

wherein the pull-down circuit is configured to control a level of a pull-down node under control of both the level of the pull-up node and a level of a pull-down control node;

the pull-down control circuit is configured to control the level of the pull-down control node under control of the level of the pull-up node;

the pull-up node noise reduction circuit is configured to reduce noise of the pull-up node under control of the level of the pull-down node; and the output noise reduction circuit is configured to reduce noise of the first output terminal under control of the level of the pull-down node.

10. A gate driving circuit, comprising a bilateral driving circuit, wherein each side of the bilateral driving circuit comprises a plurality of cascaded gate scanning signal control circuits each according to claim 6.

11. A display device, comprising the gate driving circuit according to claim 10.

12. The display device according to claim 11, further comprising a plurality of pixel units distributed in an array, a plurality of gate lines, and a plurality of common electrode lines, wherein pixel units in each row are connected to a same gate line and a same common electrode line, and the same gate line is electrically connected to the second output terminal of a gate scanning signal control circuit corresponding to the pixel units in the row of the bilateral driving circuit, and the same common electrode line is electrically connected to the third output terminal of the gate scanning signal control circuit corresponding to the pixel units in the row of the bilateral driving circuit.

13. The display device according to claim 12, wherein a first side driving circuit and a second side driving circuit of the bilateral driving circuit are capable of driving the same gate line in each row simultaneously.

14. A driving method of the gate driving circuit according to claim 10, comprising:

outputting the gate scanning signal to the second output terminal and the third output terminal simultaneously under control of the gate scanning signal.

15. The driving method of the gate driving circuit according to claim 14, further comprising:

by the third output terminal of the switching circuit, outputting a common voltage when the gate scanning signal is at a first level; and by the second output terminal and the third output terminal of the switching circuit, outputting the gate scanning signal when the gate scanning signal is at a second level.

* * * * *